US008384049B1

(12) United States Patent
Broad

(10) Patent No.: US 8,384,049 B1
(45) Date of Patent: Feb. 26, 2013

(54) RADIOTHERAPY APPARATUS AND A MULTI-LEAF COLLIMATOR THEREFOR

(75) Inventor: Martin Broad, Bromley (GB)

(73) Assignee: Elekta AB (publ), Stockholm (SE)

( * ) Notice: Subject to any disclaimer, the term of this patent is extended or adjusted under 35 U.S.C. 154(b) by 0 days.

(21) Appl. No.: 13/455,274

(22) Filed: Apr. 25, 2012

(51) Int. Cl.
*G21K 1/04* (2006.01)

(52) U.S. Cl. ..... 250/492.1; 250/492.2; 250/492.3; 378/152

(58) Field of Classification Search .... 250/492.1–492.3; 378/145, 147, 150, 151, 152
See application file for complete search history.

(56) References Cited

U.S. PATENT DOCUMENTS

| | | | | |
|---|---|---|---|---|
| 7,792,252 | B2 | 9/2010 | Bohn | 378/152 |
| 2008/0165930 | A1 * | 7/2008 | Perkins | 378/152 |
| 2009/0262901 | A1 * | 10/2009 | Broad et al. | 378/152 |

FOREIGN PATENT DOCUMENTS

WO WO 2009/129817 10/2009

OTHER PUBLICATIONS

Faulhaber, "Brushless Flat DC-Micromotors" datasheet, Apr. 24, 2012.
Cedrat Technologies, Webpage "Piezo motors" (http://www.cedrat-technologies.com/en/mechatronic-products/piezo-motors-electronics/piezo-motors.html), Apr. 24, 2012.
Squiggle Motors, Webpage "Squiggle micro motor technology" (http://www.newscaletech.com/squiggle_overview.html), Apr. 24, 2012.
PCBMotor, Webpage "PCB motors" (http://pcbmotor.com/pcbmotors-17/stators-19/), Apr. 24, 2012.

* cited by examiner

*Primary Examiner* — Michael Maskell
(74) *Attorney, Agent, or Firm* — Sunstein Kann Murphy & Timbers LLP

(57) ABSTRACT

Embodiments of the present invention provide a multi-leaf collimator with a plurality of leaves and at least one motor for each leaf. The motor for each leaf has a lateral width which is equal to or narrower than the corresponding leaf, and in this way the motors can be arranged within the lateral extent of the leaf. A cut-out section in the leaf allows the motor to lie at least partially within the depth of the leaf, and in this way the drive mechanism and the multi-leaf collimator as a whole are made extremely compact. This in turn allows the leaves to be deeper than would otherwise be the case, increasing their efficacy in blocking radiation.

10 Claims, 5 Drawing Sheets

RADIOTHERAPY APPARATUS AND A MULTI-LEAF COLLIMATOR THEREFOR

TECHNICAL FIELD

The present invention relates to the collimation of a beam of radiation, and particularly to a multi-leaf collimator for use in radiotherapy systems.

BACKGROUND

Radiotherapy involves the production of a beam of ionising radiation, usually x-rays or a beam of electrons or other sub-atomic particles. This is directed towards a target region of the patient, and adversely affects the target cells (typically tumour cells) causing an alleviation of the patient's symptoms. Generally, it is preferred to delimit the radiation beam so that the dose is maximised in the target cells and minimised in the healthy cells of the patient, as this improves the efficiency of treatment and reduces the side effects suffered by the patient. For example, the radiation beam may be shaped to conform to the cross-section of the target region.

One principal component in delimiting the radiation dose is the so-called "multi-leaf collimator" (MLC). This is a collimator which sits inside the radiation head of the therapeutic system, and consists of a large number of elongate thin leaves arranged side by side laterally in an array. Each leaf is moveable longitudinally so that its tip can be extended into or withdrawn from a radiation field. The leaves can thus be positioned so as to define a variable edge to the beam of radiation, and this is used to impart a variable edge to the radiation beam passing through the radiation field. All the leaves can be withdrawn entirely to open the radiation field (even if in practice this should never occur during operation), or all the leaves can be extended to their fullest extent so as to close it down. Alternatively, some leaves can be withdrawn and some extended so as to define any desired shape, within operational limits. A multi-leaf collimator usually consists of two banks of such arrays, each bank projecting into the radiation field from opposite sides of the collimator.

The depth of each leaf is one of the parameters which defines the leaf's ability to mitigate (i.e. block) the radiation beam passing through the window. The material of manufacture also plays a part, and for this reason each leaf is typically manufactured from an element with high atomic number, such as tungsten. However, even using such materials, each leaf must have a significant depth in the direction of the beam in order to adequately block the high-energy radiation used in radiotherapy (where photons usually have energies in the megavolt range). Most leaves have a depth of between 60 and 120 mm, but in practice the deeper a leaf is, the more effective it will be in blocking and shaping the radiation.

In order to achieve a high resolution when collimating the radiation beam, each leaf should also be relatively thin in the lateral direction. That is, the tips of the leaves in the array collectively define an edge of the radiation beam. If each leaf is made as thin as possible, a greater number of leaves are used to define the edge and thus the shape of the radiation beam can be defined at a higher resolution.

Of course, the leaves on the MLC leaf bank need to be driven in some way. Given the design parameters set out above (i.e. narrow leaves arranged closely together, heavy materials, significant depth etc) this is no trivial task. Typically, this is by a series of lead screws connected to geared electric motors. The leaves are fitted with a small captive nut in which the lead screws fit, and the electric motors are fixed on a mounting plate directly behind the leaves. Rotation of the leadscrew by the motor therefore creates a linear movement of the leaf.

Our earlier application, WO 2009/129817, describes an improvement to this design in which each leaf has a lug which extends above or below the leaf, i.e. transverse to the lateral and longitudinal directions. The lug engages with a leadscrew which is itself driven by a motor. The set of motors for each leaf bank can thus sit above or below the banks of leaves rather than behind or to the side of the leaves.

However, in both prior designs the motors are arranged to the side of the leaf array. Thus a large amount of space in the radiation head is taken up by the motors rather than the leaves. If the motors could be made more compact, the depth of the leaves could be increased to take up the available space in the radiation head, in turn leading to an increase in the radiation-blocking effect of the collimator.

SUMMARY OF INVENTION

According to a first aspect of the present invention, there is provided a multi-leaf collimator, comprising: a plurality of leaves arranged next to each other in a lateral direction, each leaf having a width in the lateral direction, and being extendible across a window in a longitudinal direction to delimit a radiation beam directed through said window; and a plurality of motors, each motor for driving a respective leaf of the plurality of leaves in said longitudinal direction, wherein each leaf comprises a first portion for delimiting said radiation beam, and a second portion for engagement with a respective motor of the plurality of motors, wherein the second portion has a cut-out section defining an edge for coupling to the motor, wherein each motor has a width in the lateral direction equal to or less than the width of its respective leaf, and wherein the motor is arranged within the lateral extent of the leaf.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1:
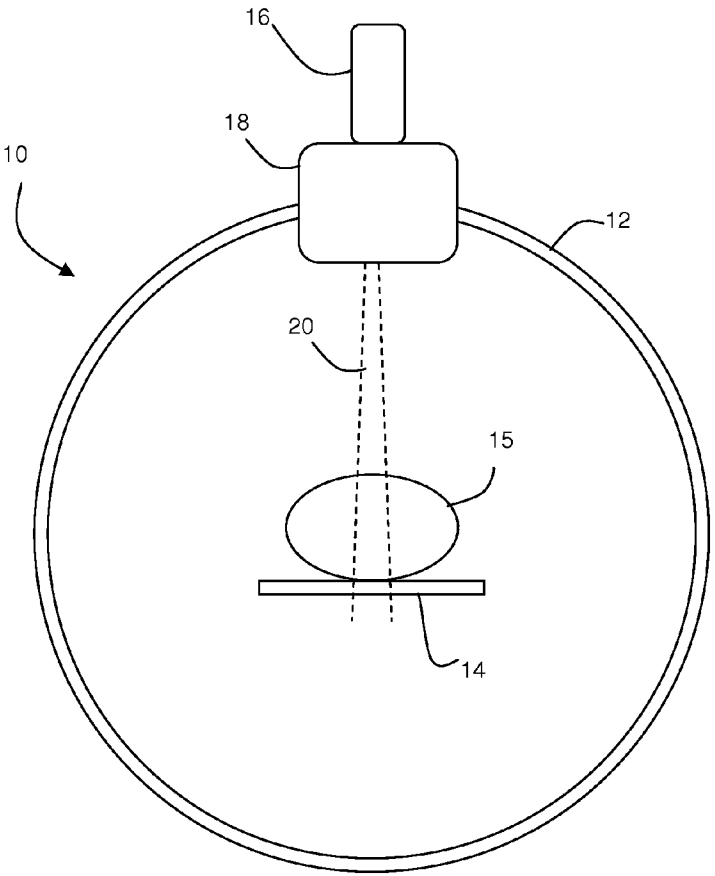
FIG. 1 shows a radiotherapy system according to embodiments of the present invention.

FIG. 1 shows a radiotherapy system 10 according to embodiments of the present invention.

The system comprises a rotatable gantry 12 and a patient support 14 located on or near the rotation axis of the gantry 12. In the illustrated embodiment the gantry 12 is depicted as a circular ring for simplicity, but those skilled in the art will appreciate that the gantry 12 may take any convenient form.

A source of therapeutic radiation 16 is mounted on the gantry 12 and directed inwards towards the axis of rotation. According to embodiments of the present invention, the source 16 comprises a linear accelerator, or linac, arranged to accelerate charged particles (such as electrons) to relativistic speeds and energies in the megavoltage (MV) range. In one embodiment, the charged particles are used to treat the patient directly, typically for targets on or near the surface of the patient as the particles do not penetrate human tissue deeply. In another embodiment, the particles are fired towards a high-density target (e.g. tungsten) to generate secondary radiation via mechanisms such as Bremsstrahlung radiation. The secondary radiation so generated includes x-rays up to and including the energy of the charged particle.

The therapeutic radiation generated by the source 16 is collimated into a beam having a primary shape (cone-shaped and fan-shaped beams are well known but other shapes are possible) by primary collimators. Further collimation is performed by secondary collimators 18, to adapt the beam to take a desired cross section. Typically the primary collimators will be fixed in place such that the overall shape of the treatment beam (i.e. before secondary collimation) is not changed during treatment. The secondary collimators tend to be more complex, however, and these may be updated during treatment to ensure the treatment beam conforms to a desired cross section. One particularly common secondary collimator is known as a multi-leaf collimator (MLC).

The combined effect of the source 16 and the collimator 18 is to produce a beam of radiation 20 having a collimated shape and an energy (typically in the MV range) which has a therapeutic effect in the patient. In use, the therapeutic beam 20 is directed generally towards the rotation axis of the gantry 12. A patient 15 is positioned on the support 14 such that the target for treatment lies on or near the rotation axis of the gantry 12. Rotation of the gantry 12 during treatment causes the beam 20 to be directed towards the target from multiple directions. The target remains in the treatment beam for most (or all) of the time and thus radiation dose accumulates to a relatively high level there. The surrounding healthy tissue also lies within the radiation beam 20 but only for a limited period of time before the gantry rotates and the beam passes through a different part of the patient 15. Radiation dose in the healthy tissue is therefore kept at a relatively low level.

Figure 2:
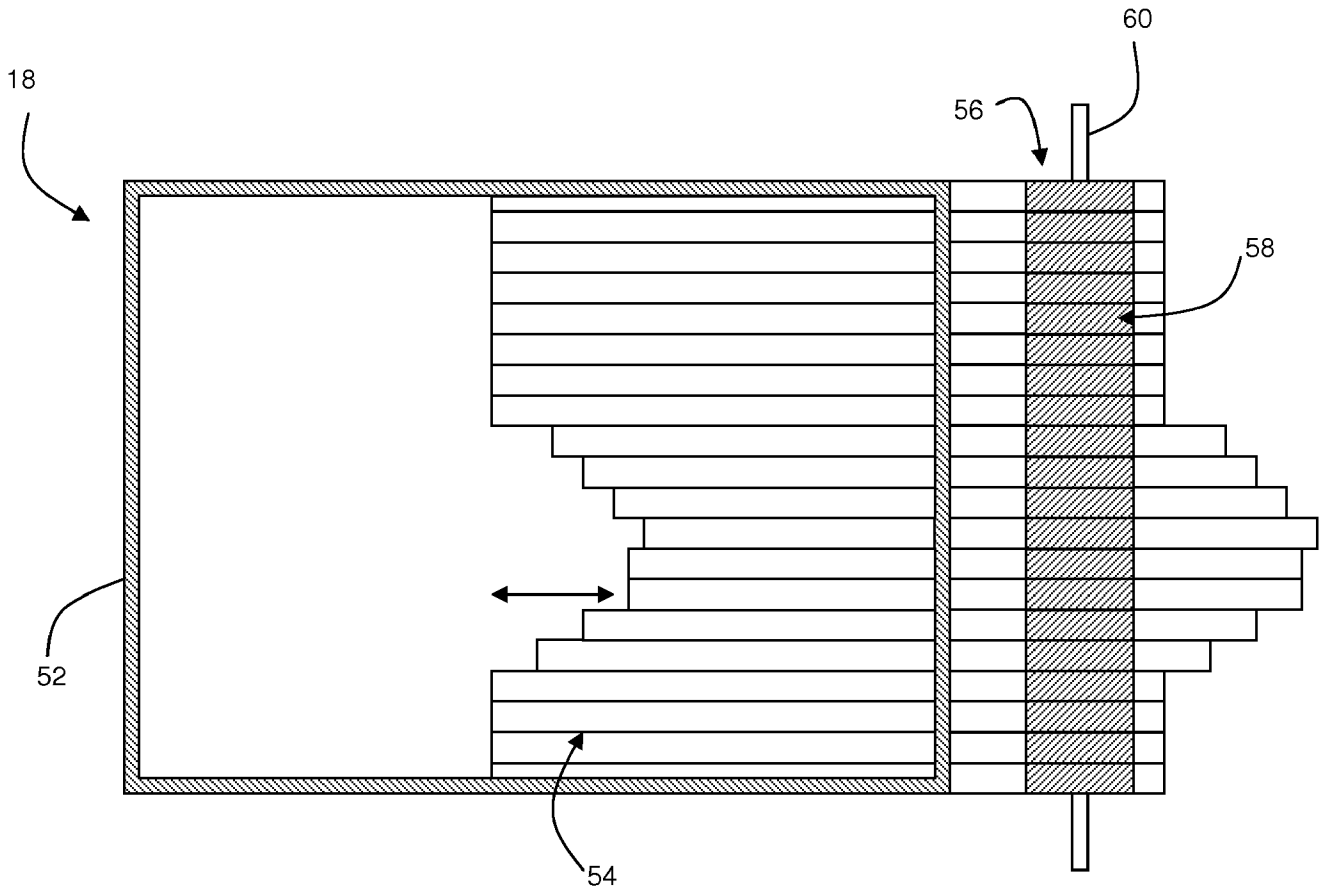
FIG. 2 shows a beam's eye view of a multi-leaf collimator according to embodiments of the present invention.

FIG. 2 shows a beam's eye view of the multi-leaf collimator 18, with the axis of the beam directed into the page. A housing defines a radiation window 52 through which the radiation beam passes after its primary collimation. A bank of elongate leaves 54 is arranged to the side of the radiation window 52, with the leaves arranged side-by-side in a lateral direction perpendicular to the beam axis. Each leaf is relatively narrow in that lateral direction, and relatively long in a longitudinal direction (perpendicular to both the beam axis and the lateral direction). Each leaf may be manufactured from a high-density material (such as tungsten), and has a significant depth in the direction of the beam axis in order to block the radiation from passing through. In use, the leaves are individually controllable to move in the longitudinal direction, in the direction indicated in FIG. 2, across the radiation window 52 to a greater or lesser extent as required. In one embodiment, each leaf can be extended across the entire radiation window or withdrawn from the entire radiation window, and can be arranged to take any position in between those two extremes. The leaves can therefore be positioned so as to define an aperture through the window 52 of an arbitrary shape, thus collimating the radiation beam to conform to that shape.

Only one array of leaves is illustrated for clarity. However, those skilled in the art will appreciate that more than one bank of leaves may be provided, with a common arrangement being to have two banks of leaves arranged on opposing sides of the window 52. Moreover, FIG. 2 is schematic in that the leaves will in practice be much thinner relative to the radiation window 52. A typical leaf may have a width of 2.5 mm, although leaves may have any width as dictated by the design of the apparatus. In one embodiment the MLC leaves may have a width in a range from 1 to 5 mm. For example, each bank of leaves may have 40 or more leaves rather than the 20 leaves illustrated.

The multi-leaf collimator 18 further comprises drive means 56 for driving the leaves 54 in the longitudinal direction illustrated. The drive means comprises a plurality of motors 58, at least one for each leaf 54. As can be seen from FIG. 2, the width of each motor is equal to or less than the width of its respective leaf, and further is arranged to lie within the lateral extent of the respective leaf. As will be described in greater detail below, each leaf may have a cut-out section in which the motor is arranged, and in this way the drive means 56 can be made extremely compact.

Each motor 58 is coupled to a shaft 60 running along the lateral direction; the position of each motor is thus fixed relative to the shaft, and the action of the motor is to move the corresponding leaf in the longitudinal direction. The shaft cross section may be circular or take any other shape.

Figure 3:
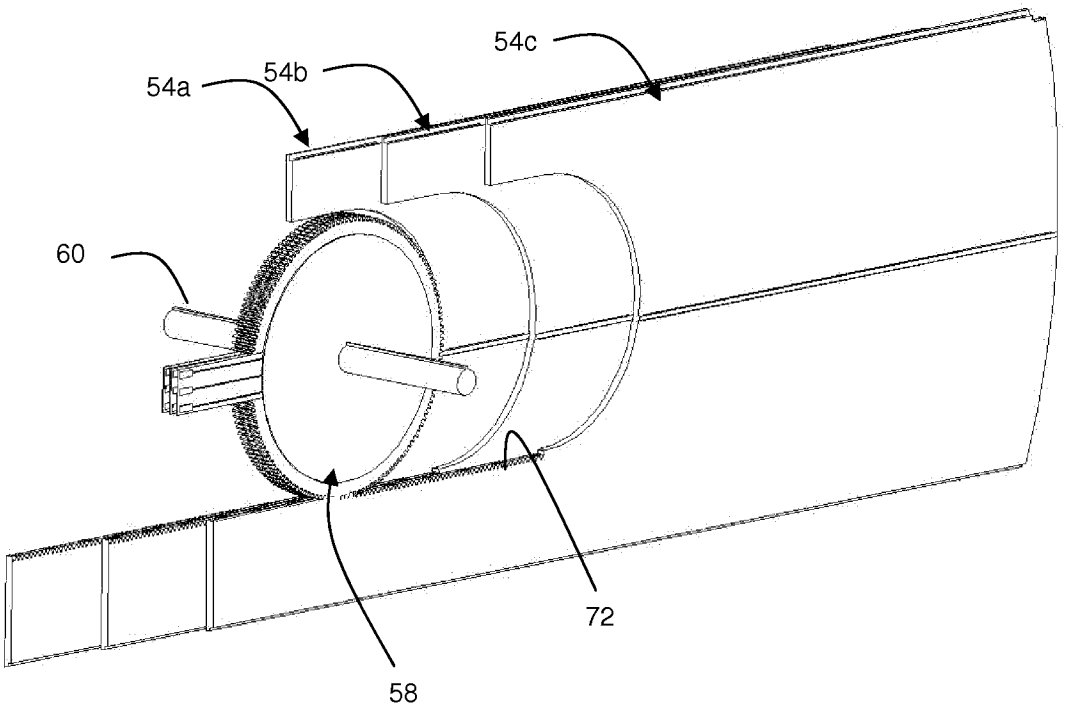
FIG. 3 shows an isometric view of three leaves of a multi-leaf collimator according to embodiments of the present invention.
Figure 4:
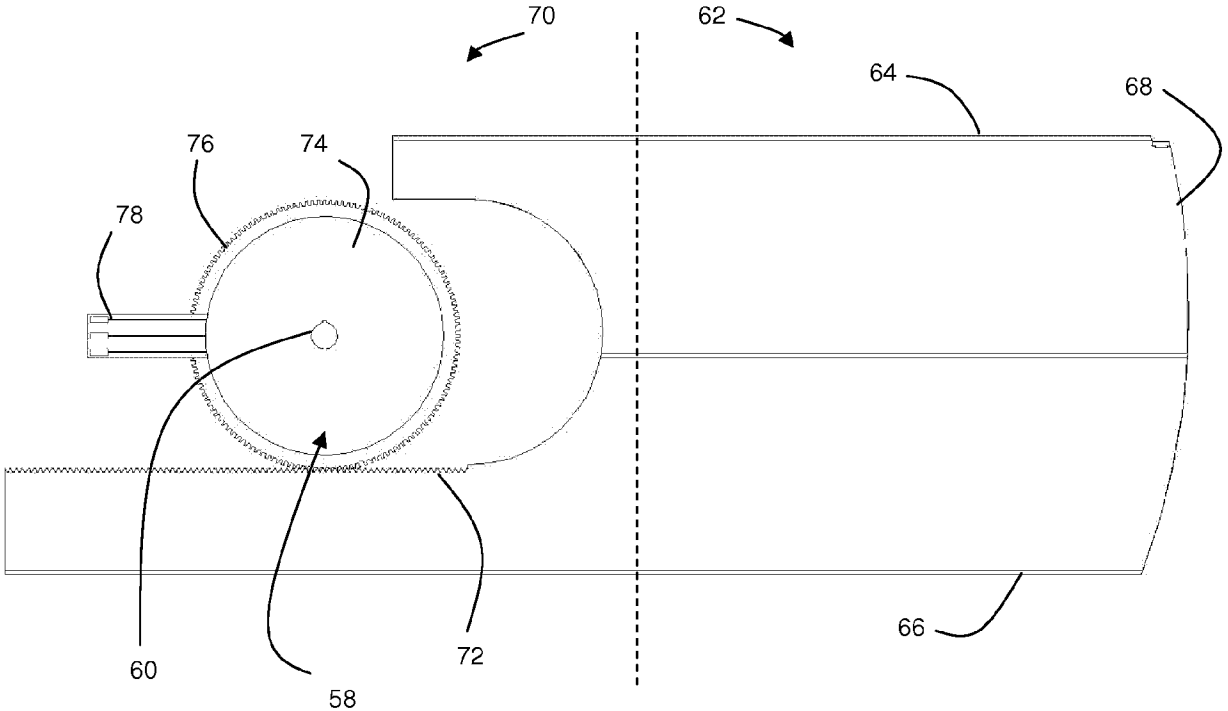
FIG. 4 shows a side elevation of a leaf of a multi-leaf collimator according to embodiments of the present invention.

FIG. 3 shows an isometric view of three leaves 54*a*, 54*b*, 54*c* according to embodiments of the present invention, removed from other elements of the multi-leaf collimator 18 for clarity. FIG. 4 shows a side elevation of a single leaf 54. The orientation of this illustration is such that the radiation beam passes vertically down the page in the direction indicated. The convention used in the following description is that locations nearer to the source of radiation are referred to as being "upper" or "top", while those locations further from the source of radiation are referred to as being "lower" or "bottom". As will be appreciated by the skilled reader, such terms are not necessarily indicative of the location's height relative to ground, as the radiation source 16 and collimator 18 may be attached to a gantry 12 able to rotate to any orientation (see FIG. 1).

Each leaf comprises a first portion 62, to the right of the dashed line in FIG. 4, which is moved across the radiation window 52 during use and acts to block radiation passing through the window. The first portion 62 comprises a continuous block of material from a top edge 64 to a bottom edge 66, and in the illustrated embodiment these edges 64, 66 define the upper- and lower-most extremes of the leaf 54 as a whole respectively. The continuous nature of the first portion 62 in the direction of the radiation beam maximizes its effectiveness in blocking the radiation. A leaf tip 68 connects the top edge 64 to the bottom edge 66, and in one embodiment this is curved in the longitudinal direction. A curved leaf tip 68 can result in a more accurately collimated radiation beam (i.e. with a narrower penumbra) owing to the divergent nature of the radiation emanating from the source 16.

Each leaf 54 further comprises a second portion 70, to the left of the dashed line in FIG. 4, with which the motor 58 can drive the leaf in the longitudinal direction. The second portion is not used to block radiation and therefore the depth of the leaf 54 in the direction of the radiation beam is not of importance. Moreover, as the second portion 70 plays no part in blocking radiation, it may be made from a different material than the first portion 62. For example, while the first portion 62 is generally manufactured from a dense material with relatively high atomic number (such as tungsten), the second portion 70 may be manufactured from a lighter material such as aluminium in order to reduce weight.

The second portion 70 has a cut-out section defining an edge 72 to which the motor is coupled. In the illustrated embodiment the edge 72 comprises a plurality of teeth, but in other embodiments the edge may be modified to present some other high-friction surface or may not be modified at all. The cut-out section is such that the edge 72 lies between the upper- and lowermost extremes of the leaf 54, as defined by the top and bottom edges 64, 66 of the first portion 62. In this way, the motor 58 is arranged at least partially within the upper- and lowermost extremes of the leaf 54. In the illustrated embodiment the motor 58 lies entirely within the upper- and lowermost extremes of the leaf 58.

Those skilled in the art will appreciate that the cut-out section can take many different shapes, and is not limited to the shape illustrated in FIGS. 3 and 4. For example, in the illustrated embodiment the cut-out section cuts short the top edge 64, as well as the rearmost edge; however, in other embodiments the cut-out section may lie entirely within the body of the leaf 54, without spoiling the edges at the extremes of the leaf's dimensions.

The motor 58 illustrated in FIG. 4 and the three motors 58 illustrated in FIG. 3 show one embodiment of the present invention. In this embodiment, the motor comprises a hub 74, coupled to the shaft 60, and a rotor 76 which rotates relative to the hub 74 about an axis coincident with the shaft 60. A power supply 78 (e.g. electric wires coupled to a power source) is connected to the hub 74 and provides power for the motor 58 to operate. Wires coupled to the motor may further provide control signals for controlling the operation of the motor 58, and/or feedback signals from the motor to the controlling entity (so as to provide information on the leaf position, for example, or to report a malfunction in the motor or the leaf). In one embodiment, the rotor 76 is axially concentric with the hub 74, and has a greater radius than the hub 74. In this way, the rotor projects outwards of the hub 74 and can engage with the edge 72 of the leaf 54. In embodiments where the edge comprises a plurality of teeth the rotor 76 may also comprise a corresponding plurality of teeth for engagement between the two in a rack-and-pinion style system.

The combination of the hub 74 and the rotor 76 together have a lateral width which is equal to or less than the lateral width of the leaf 54, and thus the entire motor 58 lies within the lateral extent of the leaf. It is necessary for the leaves 54 to lie close together such that radiation does not pass unblocked between them. When multiple leaves 54 and multiple motors 58 are combined together, as illustrated in FIG. 3, the motors are sufficiently narrow that they do not impede this close-packed arrangement. Multiple motors can be coupled to the same shaft 60, each independently operable to drive a corresponding leaf in the longitudinal direction.

As the motors 58 effectively lie within the space which would ordinarily be occupied by the leaves 54 themselves, more room is created in the radiation head of the radiotherapy apparatus. The leaves 54 can thus be made deeper (i.e. in the direction of the radiation beam) than would otherwise be the case, and radiation can be blocked more effectively.

In other embodiments, the motors 58 may take a different form. However, in each case the motors have a lateral width which is equal to or less than the width of the leaf, such that they can be arranged within the lateral extent of the leaf.

Figure 5:
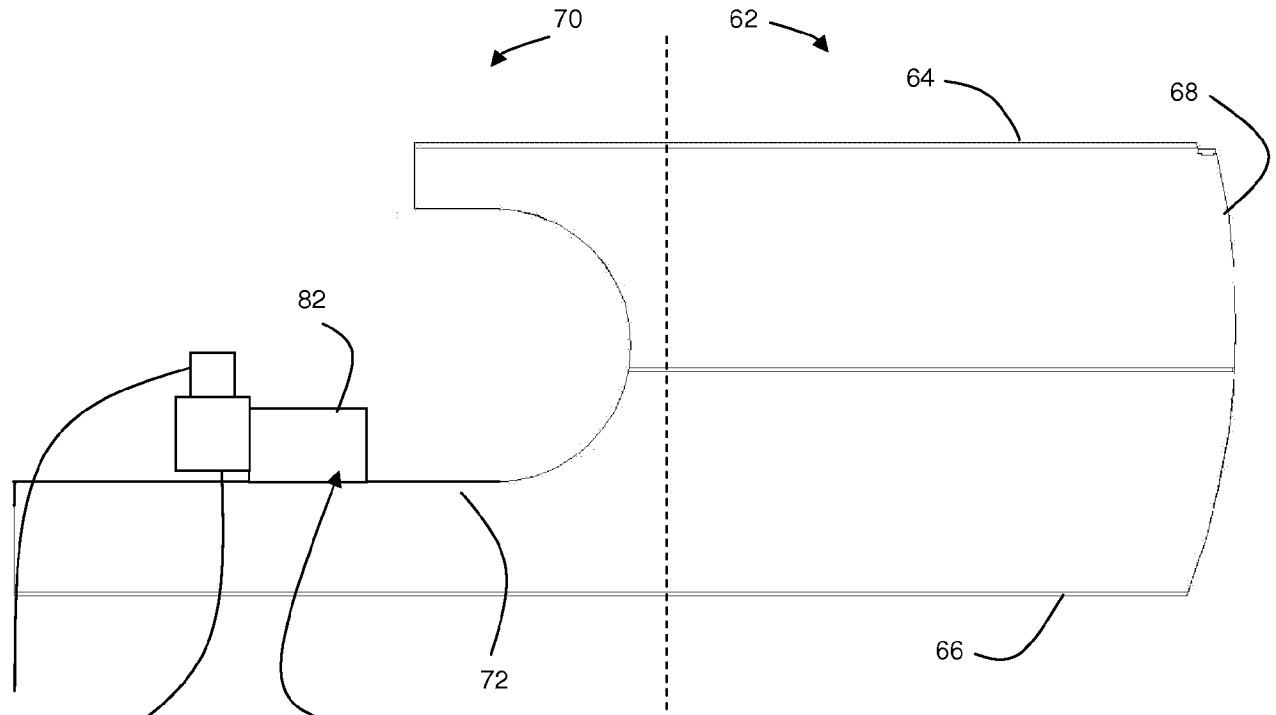
FIG. 5 shows a side elevation of a leaf of a multi-leaf collimator according to further embodiments of the present invention.

One example of such an alternative motor is illustrated in FIG. 5, where piezoelectric motors are used to drive leaves in the multi-leaf collimator. Such motors employ a piezoelectric element 80 and an actuator 82 coupled between the element 80 and the leaf edge 72. By changing the voltage applied to the piezoelectric element 80 rapidly, the actuator 82 can be moved with sufficient force to overcome the frictional force between the actuator and the leaf edge, such that the actuator moves relative to the leaf (while the leaf remains stationary). The voltage to the piezoelectric element can then be changed in the opposite direction more slowly, such that the frictional forces between the actuator and the leaf edge are not overcome. If the piezoelectric element is fixed with respect to the multi-leaf collimator (for example through a fixing to the shaft 60), the leaf will be moved a short distance through its frictional coupling to the actuator. By repeating the process, the leaf can be moved through greater distances in a stepping motion. A more detailed explanation of this method of driving multi-leaf collimator leaves can be found in U.S. Pat. No. 7,792,252.

Other motors which may be manufactured in a form which is narrower or equal in width to the leaves include: a piezoelectric "squiggle"® motor manufactured by New Scale Technologies; and motors mounted on a printed circuit board (such as those manufactured by PCBMotor). The invention is not limited to any particular type of motor, except that they have a lateral width which is equal to or less than the width of the leaves.

Embodiments of the present invention thus provide a multi-leaf collimator with a plurality of leaves and at least one motor for each leaf. The motor for each leaf has a lateral width which is equal to or narrower than the corresponding leaf, and in this way the motors can be arranged within the lateral extent of the leaf. A cut-out section in the leaf allows the motor to lie at least partially within the depth of the leaf, and in this way the drive mechanism and the multi-leaf collimator as a whole are made extremely compact. This in turn allows the leaves to be deeper than would otherwise be the case, increasing their efficacy in blocking radiation.

Those skilled in the art will appreciate that various amendments and alterations can be made to the embodiments described above without departing from the scope of the invention as defined in the claims appended hereto.

The invention claimed is:

1. A multi-leaf collimator, comprising:

a plurality of leaves arranged next to each other in a lateral direction, each leaf having a width in the lateral direction, and being extendible across a window in a longitudinal direction to delimit a radiation beam directed through said window; and a plurality of motors, each motor for driving a respective leaf of the plurality of leaves in said longitudinal direction, wherein each leaf comprises a first portion for delimiting said radiation beam, and a second portion for engagement with a respective motor of the plurality of motors, wherein the second portion has a cut-out section defining an edge for coupling to the motor, wherein each motor has a width in the lateral direction equal to or less than the width of its respective leaf, and wherein the motor is arranged within the lateral extent of the leaf.

2. The multi-leaf collimator according to claim 1, wherein the first portion has a depth in a direction orthogonal to the lateral and longitudinal directions, and wherein the motor is further arranged at least partially within the projected extent of the first portion in the direction orthogonal to the lateral and longitudinal directions.

3. The multi-leaf collimator according to claim 1, wherein at least one of the plurality of motors comprises a hub and a rotor which rotates relative to the hub.

4. The multi-leaf collimator according to claim 3, further comprising a shaft with which the hub of the at least one of the plurality of motors engages.

5. The multi-leaf collimator according to claim 4, wherein the at least one motor further comprises a key to prevent rotation of the hub relative to the shaft.

6. The multi-leaf collimator according to claim 3, wherein the hub is arranged concentrically with the rotor.

7. The multi-leaf collimator according to claim 6, wherein the rotor has a greater radial extent than the hub.

8. The multi-leaf collimator according to claim 3, wherein the rotor comprises a first plurality of teeth for engaging a second plurality of teeth arranged on the edge defined by the cut-out section.

9. The multi-leaf collimator according to claim 1, wherein the plurality of motors comprises at least one of: a piezoelectric motor or a motor mounted on a printed circuit board.

10. A radiotherapy apparatus comprising a multi-leaf collimator according to claim 1.

* * * * *